US005761855A

United States Patent [19]

Uang

[11] Patent Number: 5,761,855

[45] Date of Patent: Jun. 9, 1998

[54] STRUCTURE AND METHOD OF IMPLEMENTING A SUPPLEMENTARY COLUMN FOR SUPPORTING A RAISED FLOOR

[75] Inventor: Horng-Jong Uang, Taichung, Taiwan

[73] Assignee: Vanguard Semiconductor Corporation, Taiwan

[21] Appl. No.: 691,521

[22] Filed: Aug. 2, 1996

[30] Foreign Application Priority Data

Jun. 28, 1996 [TW] Taiwan ..... 85107850

[51] Int. Cl.[6] ..... E04F 15/00

[52] U.S. Cl. ..... 52/126.6; 52/126.1; 52/263; 52/281; 52/745.05; 248/287.1

[58] Field of Search ..... 52/64, 126.1, 126.5, 52/126.6, 127.1, 127.2, 241, 243, 263, 281, 283, 292, 731.1, 731.5, 731.8, 731.9, 736.1, 737.1, 737.2, 745.05, 745.17, 745.18, 749.1; 248/287.1, 295.11, 298.1

[56] References Cited

U.S. PATENT DOCUMENTS

| | | | |
|---|---|---|---|
| 3,900,179 | 8/1975 | Mocny et al. | 248/287.1 |
| 4,112,638 | 9/1978 | Hanson, Sr. | 52/126.1 X |
| 4,682,453 | 7/1987 | Homgren | 52/126.5 X |
| 4,850,162 | 7/1989 | Albrecht | 52/126.6 |
| 5,186,430 | 2/1993 | Ellithorpe | 52/126.1 |
| 5,265,386 | 11/1993 | Mëhlethaler | 52/126.6 |
| 5,487,518 | 1/1996 | McCraney et al. | 248/298.1 X |

*Primary Examiner*—Carl D. Friedman
*Assistant Examiner*—Kevin D. Wilkins
*Attorney, Agent, or Firm*—Rabin, Champagne, & Lynt, P.C.

[57] ABSTRACT

An apparatus and method for implementing a supplementary column structure for supporting a raised floor. The apparatus includes a number of fixed supporting columns above a lower floor to support at least one raised floor. Each fixed supporting, column has two ends, one of which is attached to a base block fixed to the lower floor while the other end is attached to all upper connecting block supporting the raised floor. The method of adding the supplementary columns includes first choosing two fixed supporting columns and installing a horizontal beam with a U-shaped groove between the two fixed columns. At least one supplementary column is then provided, each supplementary column being attached to an I-shaped slidable base block enclosed by the grooved horizontal beam at its one end, and to an upper connecting, block supporting the raised floor at its other end. The supplementary column can then slide along the groove of the horizontal beam until a desired location is reached.

10 Claims, 5 Drawing Sheets

STRUCTURE AND METHOD OF IMPLEMENTING A SUPPLEMENTARY COLUMN FOR SUPPORTING A RAISED FLOOR

BACKGROUND OF THE INVENTION

1. Field of the Invention

The invention relates in general to a supplementary column structure and a method of implementation for supporting a raised floor and more particularly to a supplementary column structure and a method of implementation with a mechanism enabling the column to slide in a predetermined direction until a suitable location is reached.

2. Description of the Related Art

Conventionally, in order to fully utilize all the space in a semiconductor manufacturing plant, it is common to have a raised floor erected above a reinforced concrete (RC) floor for the laying of ducts or wiring associated with machines.

An example of this is a clean room as shown in FIGS. 1A and 1B. FIG. 1A is a top view of a conventional supporting column structure for a raised floor, and FIG. 1B is a cross-sectional view along line 1—1 of FIG. 1A. Referring to FIG. 1A, the raised platform 201 is supported by four fixed supporting columns 3, 3', 4, and 4' above the PC floor 100 (as shown in FIG. 1B). Each raised platform such as platform 201 or 202 has an equal unit surface area. Sometimes when a machine (not shown) is installed on a raised platform, such as platform 202, a hole 7 is cut out from the middle so that the associated wiring and ducts can be reached from the space above the RC flooring 100. However, in most cases, raised platforms with fixed surface areas are too inflexible for the installation of machines and its associated wiring and ducts. Therefore, raised platforms are often cut into separate pieces. For example, raised platform 205 is cut into two raised platforms 203 and 204 (or raised platform 203 is taken away) having different floor sizes. As a result, supplementary columns 5 and 6 are required to support the junction between raised platform 203 and 204.

The fixed supporting columns 1–4 and supplementary columns 5 and 6 are attached to upper connecting blocks at the upper ends and lower base blocks at the lower ends, such as the upper connecting blocks 1*a*, 4*a*, and 5*a* and lower base blocks 1*b*, 4*b*, and 5*b* attached to respective columns 1 and 4 and supplementary column 5 (as shown in FIG. 1B). The upper connecting blocks support the raised platform while the lower base blocks are fixed in position to the RC floor by silicon glue.

The aforementioned conventional technique has at least the following drawbacks:

1. After the fixation of supplementary columns 5 and 6, it becomes hard to reposition them as situations demand, thereby causing significant design inconvenience.
2. Whenever it is required to change positions of the machines, wiring, or ducts, it can only be done through disassembling the supplementary supporting columns to correlate with the new design. Such removal work involves grinding away the silicon glue, which generates fine dust particles that can contaminate the clean room area.

SUMMARY OF THE INVENTION

It is therefore an object of the invention to provide a raised floor structure and a method for the implementation of supplementary columns for supporting a raised floor.

One feature of the invention is a horizontal beam having one or more guiding rails that enable a supplementary column to slide along the guiding rails until a desired location is reached, and the use thereof.

Another feature of the invention is a horizontal beam having at least one U-shaped groove to enable a supplementary column with an I-shaped slidable base block to move along the grooved horizontal beam until a desired location is reached, and the use thereof Another object of the invention is to provide a supplementary column structure with a locking mechanism such that when the slidable base block of the supplementary column has slid along the grooved horizontal beam to a desired location, the locking mechanism can be applied to fasten the supplementary column onto the horizontal beam.

Following the objects defined above, the invention provides a method for the implementation of at least one supplementary column to support at least one raised floor. The method includes the following steps. A number of fixed supporting columns are erected above a lower, usually concrete, floor to support the raised platform. Each fixed supporting column has two ends, one end attached to a base block fixed to the lower floor and the other end attached to an upper connecting block supporting the raised floor. Supplementary column(s) are then added. Two fixed supporting columns are chosen and at least one horizontal beam having at least one U-shaped groove is disposed between the two fixed columns. Each supplementary column is attached to an I-shaped slidable base block enclosed by the grooved horizontal beam at one of its ends. An upper connecting block supporting the raised floor is attached to the other end of each supporting column. The supplementary column can thus slide along the groove of the horizontal beam until a desired location is reached.

Following the objectives defined above, the present invention also provides a supplementary column structure. The structure includes a horizontal beam having one or more guiding rails and a supplementary column. The supplementary column has one of its ends attached to a base block enclosed within at least one guiding rail of the horizontal beam, and its other end attached to an upper connecting block for supporting a raised floor. The supplementary column can thus slide along the guiding rail(s) of the horizontal beam until a desired location is reached.

BRIEF DESCRIPTION OF THE DRAWINGS

Other objects, features, and advantages of the invention will become apparent from the following detailed description of the preferred, but non-limiting, embodiments. The description is made with reference to the accompanying drawings in which.

DESCRIPTION OF THE PREFERRED EMBODIMENTS

Figure 1A:
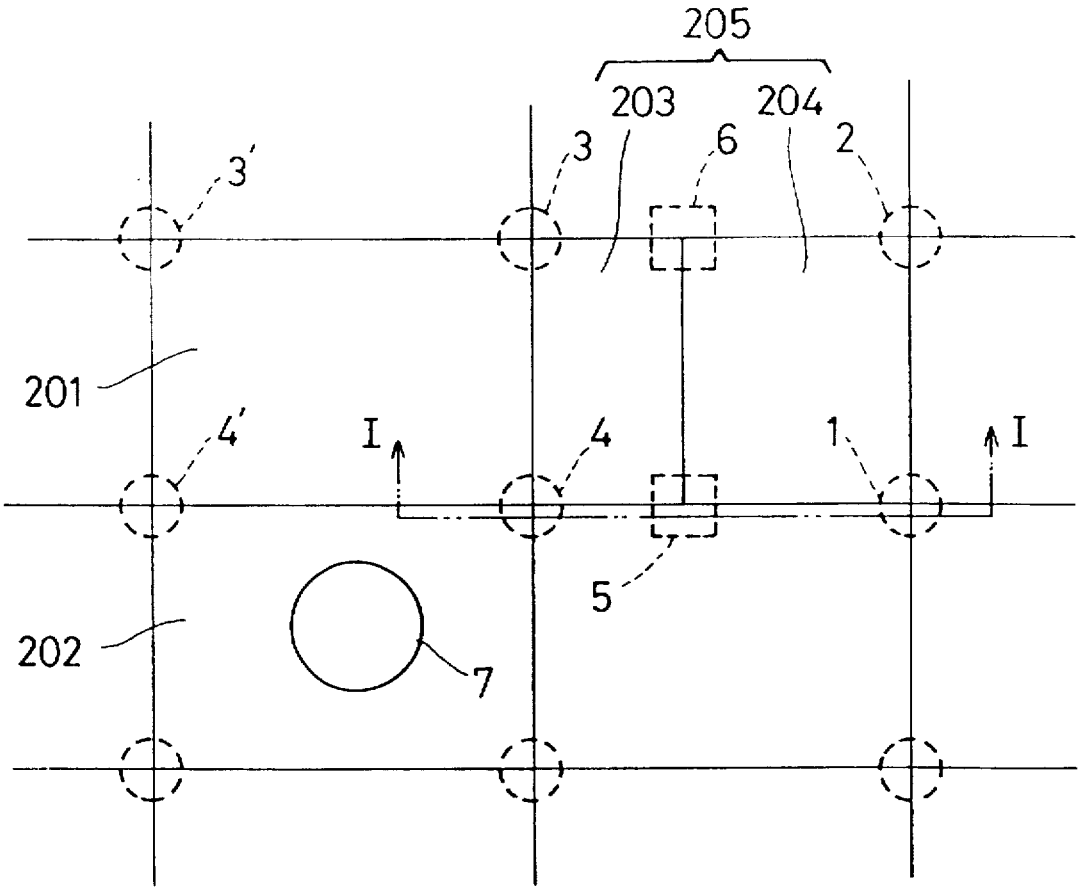
FIG.1A(PRIOR ART)
FIG. 1A is a top view of a conventional supporting column structure of a raised floor.
Figure 1B:
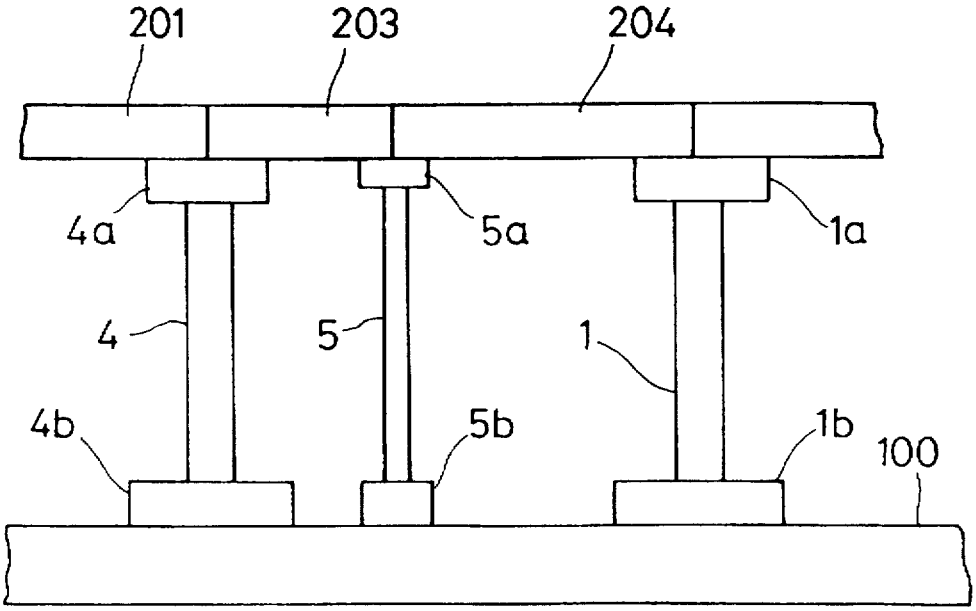
FIG.1B(PRIOR ART)
FIG. 1B is a cross-sectional view along line I—I of FIG. 1A.
Figure 2A:
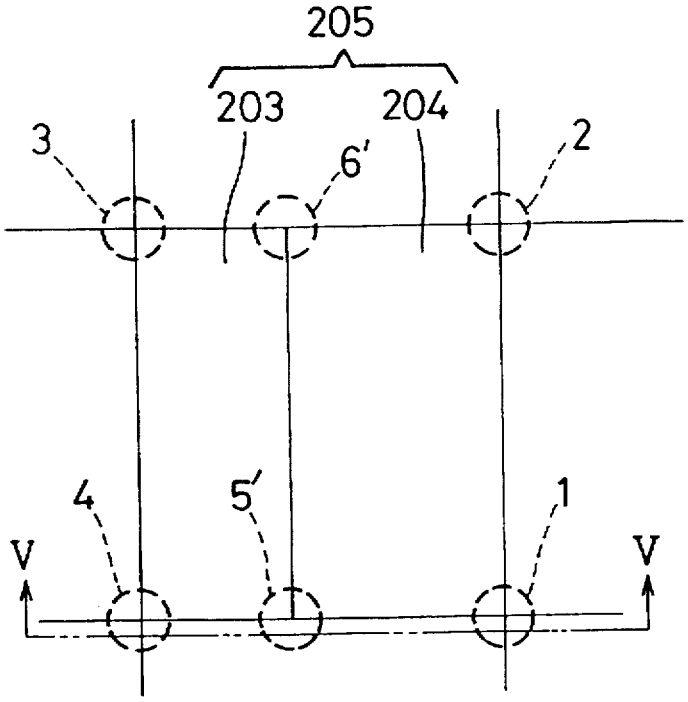
FIG. 2A is a top view of the raised floor of the invention showing supporting columns and their accessory components for a first preferred embodiment of a raised floor.
Figure 2B:
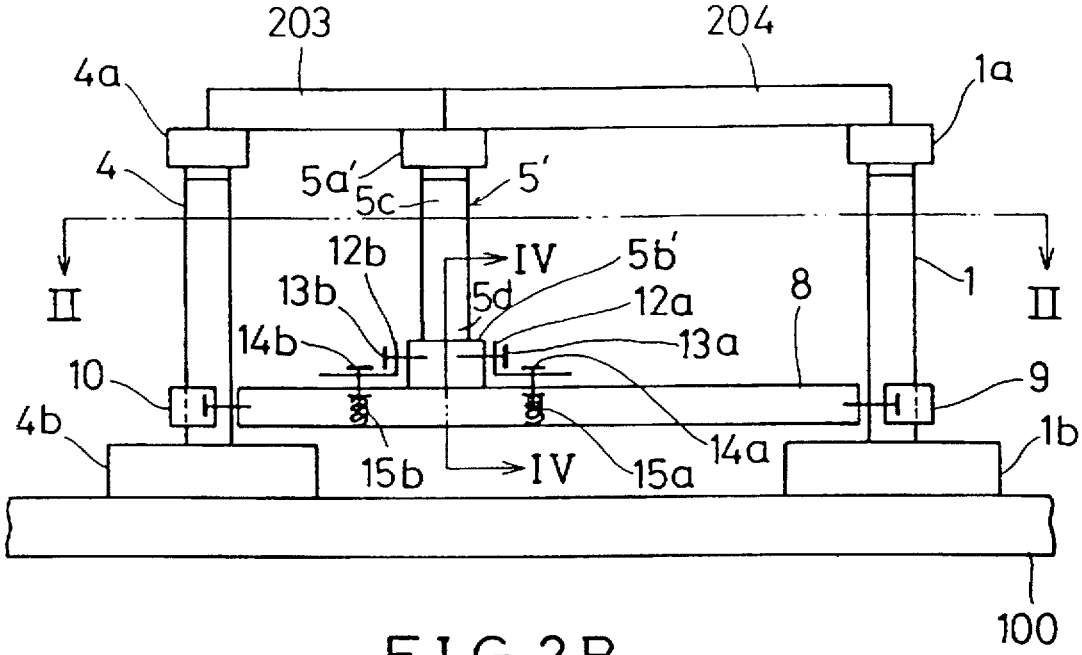
FIG. 2B is a cross-sectional view along line V—V of FIG. 2A.
Figure 2C:
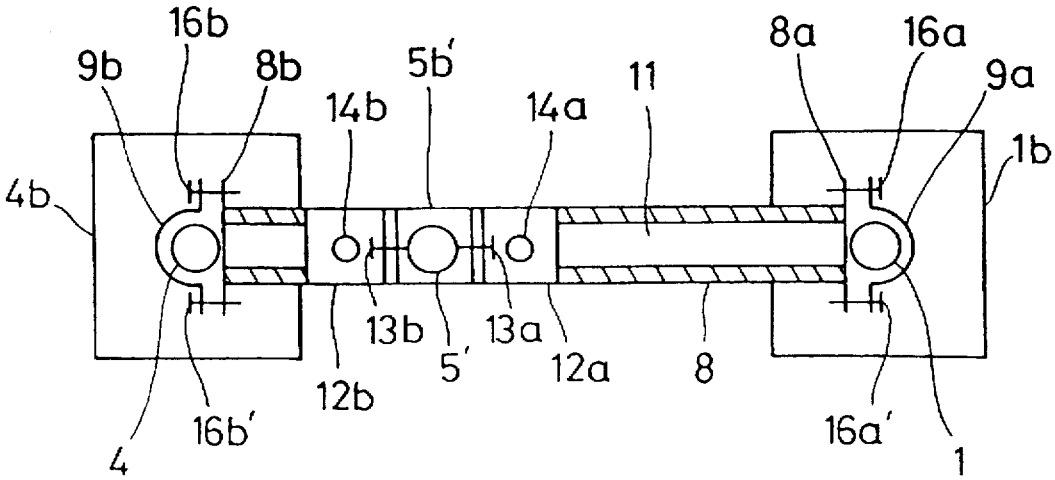
FIG. 2C is a cross-sectional view along line II—II of FIG. 2B.

FIGS. 2A to 2C represent structures and components of a first preferred embodiment with FIG. 2A being a general schematic layout of the invention. The numbering convention is such that similar functional components are referenced similarly.

Referring to FIG. 2A, at least one raised platform 205 is set up above a floor area, such as a reinforced concrete (RC) floor 100 (FIG. 2B) and is supported by a number of fixed supporting columns 1–4. To facilitate the placement of machines and their appurtenant wiring (as previously discussed, raised platforms having fixed shapes and sizes are sometimes too inflexible), it is necessary either to cut up the raised platform area into separate pieces 203 and 204, or to take out one of the raised floor platforms, such as 203. In any case, supplementary columns 5' and 6' must be added at the junction between platforms 203 and 204.

FIG. 2B is a cross-sectional view along line V—V of FIG. 2A. It shows that one end of each of the fixed supporting columns 1 and 4 is attached to base blocks **1*b* and 4*b*, respectively, fixed on an RC floor 100, while the opposite ends of the supporting columns are attached to upper connecting blocks 1*a* and 4*a* supporting the raised platforms 203 and 204**, respectively.

FIG. 2C is a cross-sectional view along line II—II of FIG. 2B. It shows the supporting structure of the present invention which comprises a horizontal beam 8 with groove 11 acting as a guiding rail so that any supporting column with a slidable base block can ride on the guiding rail and move to its intended location. A detailed discussion of one preferred embodiment will now be put forth.

The guiding rail includes horizontal beam 8 with groove 11 and is installed between the two fixed supporting columns 1 and 4. Upper end **5*c* of supplementary column 5' is attached to an upper connecting block 5*a*', which is used for supporting the separated raised platforms 203 and 204, and lower end 5*d* of supplementary column 5' is attached to a slidable base block portion 5*b*'**.

The two ends of horizontal beam 8 engage face plates **8*a* and 8*b* at the connective sections of the horizontal beam 8. The face plates 8*a* and 8*b* are part of a fastening assembly onto the fixed supporting columns 1 and 4 respectively. The fastening assembly comprises semicircular brackets 9*a* and 9*b*, face plates 8*a* and 8*b*, and screws 16*a*, 16*a*', 16*b* and 16*b*'. In this preferred embodiment, the semicircular brackets 9*a* and 9*b* are used to clamp the horizontal beam 8 onto supporting columns 1 and 4 near their base blocks 1*b* and 4*b*. By tightening up screws 16*a*, 16*a*', 16*b* and 16*b*', the semicircular brackets 9*a* and 9*b* are pressed against the face plates 8*a* and 8*b*, and the horizontal beam 8 is clamped tightly onto the fixed supporting columns 1 and 4, which enables the groove 11 of horizontal beam 8, to guide any movement of any supplementary column 5'**.

Figure 3A:
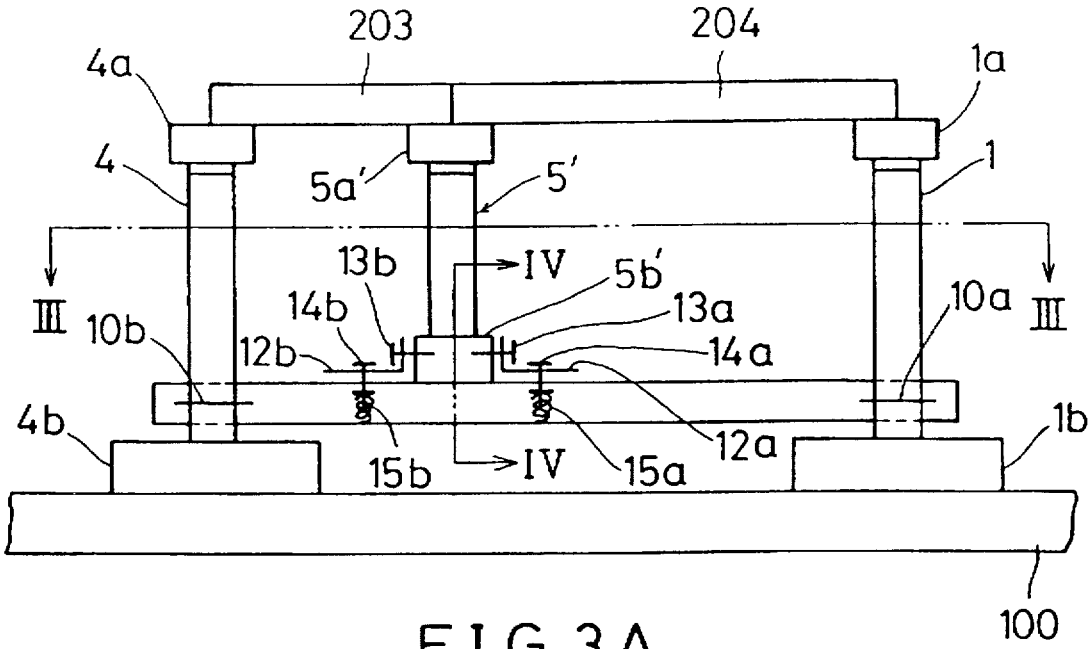
FIG. 3A is a cross-sectional view along line V—V of FIG. 2A showing supporting columns and their accessory components for a second preferred embodiment of a raised floor.
Figure 3B:
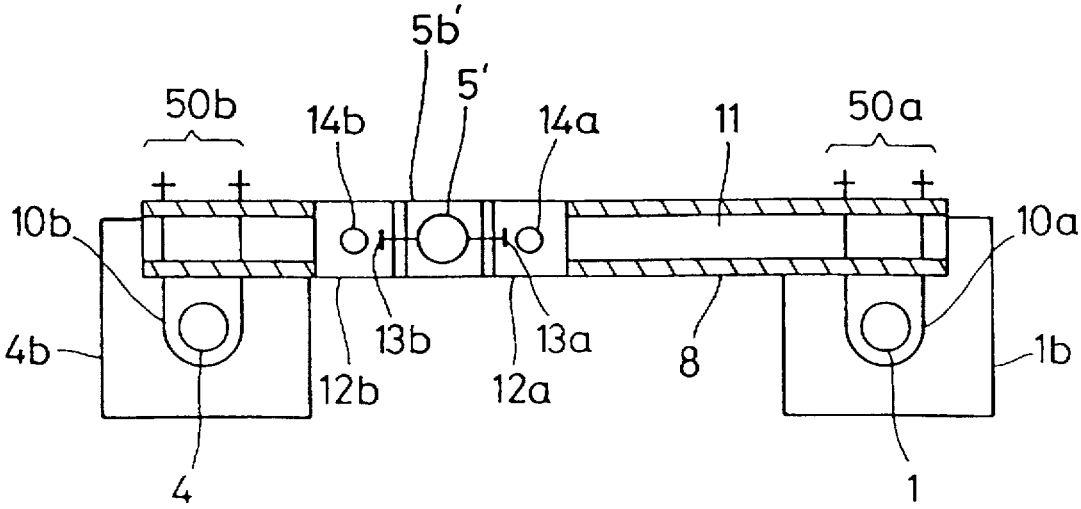
FIG. 3B is a cross-sectional view along line III—III of FIG. 3A.

FIGS. 3A and 3B show a second preferred embodiment of the invention and will be discussed in detail below, but first the cross-sectional line along IV—IV of FIG. 2B will be addressed.

Figure 4:
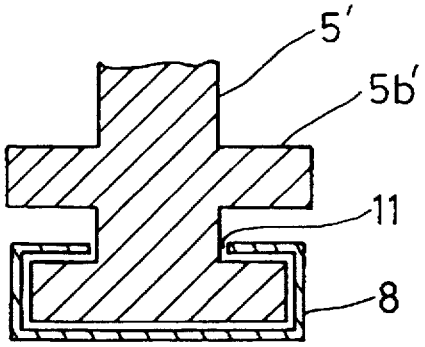
FIG. 4 is a cross-sectional view along line IV—IV of FIGS. 2B and 3A showing a slidable base block and its associated grooved beam profiles.

FIG. 4 is a cross-sectional view along line IV—IV of FIG. 2B showing a slidable base block portion **5*b*' of supplementary column 5' and its associated grooved beam profile. The slidable base block portion 5*b*' of supplementary column 5' is I-shaped and the groove 11 of horizontal beam 8** is U-shaped, whereby, with such profiles, the slidable base block can easily move along the horizontal groove to any location that may be desired. The aforementioned I-shaped slidable base block and U-shaped grooved beam form just one of the preferred embodiments of the present invention, which, therefore, should not be limited thereto.

Referring to FIGS. 2A–2C and 4, when the supplementary column 5' has moved to a desired location along groove 11 of horizontal beam 8, a locking mechanism is used to fasten the column 5' along the horizontal beam 8. For example, the locking mechanism can be composed of L-shaped brackets **12*a* and 12*b*, screws 13*a*, 13*b*, 14*a*, and 14*b*, and spring-loaded locknuts 15*a* and 15*b*. The L-shaped brackets 12*a* and 12*b* are placed such that they occupy the position where the base block of supplementary column 5' and the surface of horizontal beam 8 form a right angle. Screws 13*a* and 13*b* pass through the vertical sides of L-shaped brackets 12*a* and 12*b*, respectively, and lock them to the base block portion 5*b*' of the supplementary column 5'. Screws 14*a* and 14*b* pass through the horizontal surfaces of L-shaped brackets 12*a* and 12*b*, respectively, and lock them to the horizontal beam 8 by tightly gripping the spring-attached locknuts 15*a* and 15*b* inside the groove of horizontal beam 8. Using the above design, the supplementary column 5' can be transported to other parts of horizontal beam 8** by simply loosening some screws, moving the supplementary column and re-tightening the screws. Such a design avoids the problems of the conventional technique, including having to disassemble and reassemble the fixed supplementary columns, which can cause loose dust and particles to fly around whenever new set-ups are implemented.

FIGS. 3A and 3B illustrate a second preferred embodiment of the invention. There are many similarities between this preferred embodiment and the previous one, and so detailed explanations will be omitted here. Functionally similar components are marked similarly in the Figures.

One characteristic of this second preferred embodiment lies in the fastening assembly between the horizontal beam 8 and the fixed supporting columns 1 and 4. In this embodiment, two U-shaped bolts **10*a* and 10*b* are used such that the U-shaped portions of the bolts wrap the fixed supporting columns 1 and 4, respectively, and in turns the two legs of each of the U-bolts pass through the horizontal beam and are fastened by two locknuts 50*a* and 50*b***, respectively.

According to this preferred embodiment, there is no need to provide any face plates at the two ends of the horizontal beam, thus making assembly easier and faster.

While the invention has been described by way of example and in terms of preferred embodiments, it is to be understood that the invention is not to be limited thereto. To the contrary, it is intended to cover various modifications and similar arrangements. The appended claims, therefore, should be accorded the broadest interpretation so as to encompass all such modifications and similar structures.

What is claimed is:

1. A supplementary column structure comprising:

a horizontal beam having a guiding rail; and a supplementary column having, at one end, a base block slidably attached to the guiding rail, and being attached at another end to an upper connecting block for supporting a raised platform, whereby the base block and the supplementary column can slide along the guiding rail of the horizontal beam until a desired location is reached;

wherein the base block of the supplementary column comprises an I-shaped slidable block.

2. A supplementary column structure comprising:

a horizontal beam having a guiding rail; and a supplementary column having, at one end, a base block slidably attached to the guiding rail and above the horizontal beam, and being attached at another end to an upper connecting block for supporting a raised platform, whereby the base block and the supplementary column can slide along the guiding rail of the horizontal beam until a desired location is reached;

further comprising a locking mechanism, for fixing the supplementary column onto a top surface of the horizontal beam in the desired location, wherein the locking mechanism comprises:

an L-shaped bracket disposed at a nexus of the base block and the horizontal beam;

at least one first fastening means for fastening the L-shaped bracket to the base block;

at least one locking means installed inside the guiding rail; and at least one second fastening means for fastening the L-shaped bracket to the locking means, wherein the locking means grips the guiding rail to fix the supplementary column in the desired location.

3. A supplementary column structure comprising:

a horizontal beam having a guiding rail; and a supplementary column having, at one end, a base block slidably attached to the guiding rail and above the horizontal beam, and being attached at another end to an upper connecting block for supporting a raised platform, whereby the base block and the supplementary column can slide along the guiding rail of the horizontal beam until a desired location is reached;

further comprising a locking mechanism, for fixing the supplementary column onto a top surface of the horizontal beam in the desired location, wherein the locking mechanism comprises:

an L-shaped bracket disposed at a nexus of the base block and the horizontal beam;

at least one first fastening means for fastening the L-shaped bracket to the base block;

at least one locking means installed inside the guiding rail; and at least one second fastening means for fastening the L-shaped bracket to the locking means, wherein the locking means grips the guiding rail to fix the supplementary column in the desired location and the first and second fastening means comprise screws.

4. A supplementary column structure comprising:

a horizontal beam having a guiding rail; and a supplementary column having, at one end, a base block slidably attached to the guiding rail, and being attached at another end to an upper connecting block for supporting a raised platform, whereby the base block and the supplementary column can slide along the guiding rail of the horizontal beam until a desired location is reached;

further comprising a locking mechanism, for fixing the supplementary column onto the horizontal beam in the desired location, wherein the locking mechanism comprises:

an L-shaped bracket disposed at a nexus of the base block and the horizontal beam;

at least one first fastening means for fastening the L-shaped bracket to the base block;

at least one locking means installed inside the guiding rail; and at least one second fastening means for fastening the L-shaped bracket to the locking means, wherein the locking means grips the guiding rail to fix the supplementary column in the desired location and the locking means comprises a spring-loaded locknut.

5. A supplementary column structure comprising:

a horizontal beam having a guiding rail; and a supplementary column having, at one end, a base block slidably attached to the guiding rail, and being attached at another end to an upper connecting block for supporting a raised platform, whereby the base block and the supplementary column can slide along the guiding rail of the horizontal beam until a desired location is reached;

further comprising a locking mechanism, for fixing the supplementary column onto the horizontal beam in the desired location, wherein the locking mechanism comprises:

an L-shaped bracket disposed at a nexus of the base block and the horizontal beam;

at least one first fastening means for fastening the L-shaped bracket to the base block;

at least one locking means installed inside the guiding rail;

at least one second fastening means for fastening the L-shaped bracket to the locking means, wherein the locking means grips the guiding rail to fix the supplementary column in the desired location, the first and second fastening means comprise screws, and the locking means comprises a spring-loaded locknut.

6. A supplementary column structure suitable for erecting at least a second floor above a first floor employing a number of fixed supporting columns, comprising:

a horizontal beam having a groove and being disposed between two said fixed supporting columns;

at least one fixing means for fixing ends of the horizontal beam to the two said fixed supporting columns; and at least one supplementary column having one end attached to a base block slidably attached to the groove of the horizontal beam and another end attached to an upper connecting block for supporting the second floor;

wherein the supplementary column can slide along the horizontal beam until a position suitable for supporting the second floor is reached.

7. A structure according to claim 6, wherein the fixing means comprises a semicircular bracket having a U-shaped portion wrapping one of the two said fixed supporting columns and two legs passing through the horizontal beam, and a locknut for fastening the semicircular bracket to the horizontal beam.

8. A structure according to claim 6, wherein the two ends of the horizontal beam each have a connective section for engaging a fastening assembly to connect with a corresponding one of said fixed supporting columns.

9. A structure according to claim 8, wherein the fastening assembly comprises a semicircular bracket, a face plate, and screws, wherein the semicircular bracket clamps the fixed supporting column and the screws engage the face plate at the connective section at an end of the horizontal beam to tighten the semicircular bracket to the fixed supporting column.

10. A method of using at least one supplementary column to support a raised floor, comprising (a) erecting a number of fixed supporting columns above a lower floor to support said raised floor, each fixed supporting column having two ends, one end being attached to a base block fixed to the lower floor and another end being attached to an upper connecting block supporting the raised floor, and (b) adding the at least one supplementary column by:

choosing two fixed supporting columns;

disposing a horizontal beam having a U-shaped groove between the two fixed supporting columns;

attaching an end of the at least one supplementary column to an I-shaped slidable base block that is slidably attached to the grooved horizontal beam; and attaching an upper connecting block supporting the raised floor to another end of the supplementary column, wherein the supplementary column can slide along the groove of the horizontal beam until a desired location is reached.

* * * * *